United States Patent [19]

Wright

[11] 4,296,511

[45] Oct. 27, 1981

[54] WATER SKI WITH INCREASED STABILITY

[76] Inventor: Joe B. Wright, 3728 Gratia Ave., Sacramento, Calif. 95821

[21] Appl. No.: 913,856

[22] Filed: Jun. 8, 1978

[51] Int. Cl.[3] ..... A63C 5/00; A63C 15/06

[52] U.S. Cl. ..... 9/310 A; 9/310 AA; 114/67 A

[58] Field of Search ..... 9/310 R, 310 A, 310 AA, 9/310 B, 310 C, 310 D, 349; 36/117, 122; 114/67 A, 274, 290; 280/611, 624

[56] References Cited

U.S. PATENT DOCUMENTS

| | | | |
|---|---|---|---|
| 2,382,150 | 8/1945 | Hartman | 9/310 |
| 3,031,697 | 5/1962 | Klein | 9/310 A |
| 3,255,472 | 6/1966 | Thorne | 9/310 A |
| 3,284,823 | 11/1966 | Steffel | 9/310 A |
| 3,750,204 | 8/1973 | Walter | 9/310 AA |
| 3,874,315 | 4/1975 | Wright | 114/290 X |
| 4,131,963 | 1/1979 | Johnson | 9/310 AA |

*Primary Examiner*—Douglas C. Butler

*Attorney, Agent, or Firm*—Kenyon & Kenyon

[57] ABSTRACT

An aquatic device having improved stability and maneuverability comprising a member to be moved through water and a curved plate attached to the member for forming a chamber having an inlet opening and a substantially unobstructed outlet opening and a cross section whose area continuously decreases in going from the inlet opening to a point beyond the inlet opening in the direction of the outlet opening. A water ski aquatic device embodying the invention is disclosed.

24 Claims, 8 Drawing Figures

WATER SKI WITH INCREASED STABILITY

BACKGROUND OF THE INVENTION

This invention pertains to aquatic devices and, in particular, to aquatic devices of the type which are to be moved through water during operation.

Aquatic devices of the above type are many and varied. For example, boats and water skis are typical aquatic devices which have found widespread use. In designing such devices, a number of techniques have been employed to promote ease of operation of the devices. Additionally, other techniques have been used to ensure stability of the devices during such operation.

Thus, for example, a number of issued U.S. patents disclose water ski constructions designed to promote stability of the ski during its movement through the water. U.S. Pat. No. 3,731,328, issued on May 8, 1973, discloses one such ski construction wherein the bottom wall or surface of the water ski from the tail end of the ski forward to about two thirds of its length is formed as a concave channel. This channel converges toward the tail end of the ski; thereby creating a venturi-like passage. Upon movement of the ski, the water passing through the channel is, therefore, accelerated, causing the tail end of the ski to rise and increasing stability. This ski is also provided with a thin rib extending centrally along the length of the channel and a conventional fin also extending centrally from the rib to the end of the channel. These latter elements also add to ski stability.

U.S. Pat. No. 3,284,823 discloses another water ski construction which is provided with a ski stabilizer to promote ski operation. The aforesaid stabilizer is situated toward the front end of the ski and is in the form of a trough shaped member which is screwed to the bottom surface of the ski. The forward wall of the member and the rear wall of the member are provided with inlet and outlet air openings for permitting air to enter and exit the trough shaped member during movement of the ski. The member is further configured so as to taper in width and depth in moving rearwardly along the length of the ski. With this type of configuration, air entering the inlet opening of the stabilizer is accelerated in passing therethrough and is further accelerated by the vacuum at the outlet opening created by water rushing thereby. As a result, the aft or rear portion of the ski is caused to ride upon a film of air, thus reducing surface friction between the undersurface of the water ski and the water to a minimum and also affording an air cushioned and, hence, smoother ride.

U.S. Pat. No. 3,026,546 discloses a further water ski construction wherein opposing sides of the underside of the rear section of a water ski are provided with keels which taper inwardly or converge in moving toward the end of the ski. These keels produce a funneling effect which causes water passing therethrough to exit the rear end of the ski as a jet. The latter, in turn, adds buoyancy, lift and stability to the ski.

While the above patents thus describe techniques for stabilizing the operation of water ski aquatic devices, U.S. Pat. No. 3,031,697 describes a water ski construction designed to facilitate ease of operation. In this water ski construction, the rear end of the water ski is weighted by a rectangular plate, while the front end of the water ski is provided with a buoyant element. In this manner, when the ski is placed in water, the ski sinks and assumes an inclined position with the rear end of the ski in the water and the front end of the ski projecting upwardly out of the water. The ski, therefore, automatically assumes the position necessary for starting. Moreover, after a fall or an intentional drop, the ski will revert to its upright position making it highly visible for the skier to locate.

Additional U.S. patents directed to different constructions of water ski aquatic devices for promoting stability and/or use of such devices are as follows: U.S. Pat. No. 2,382,150 issued Aug. 14, 1945; U.S. Pat. No. 3,040,345 issued on June 26, 1962; U.S. Pat. No. 3,173,161 issued on Mar. 16, 1965; U.S. Pat. No. 3,118,157 issued on Jan. 21, 1964; U.S. Pat. No. 3,716,881 issued on Feb. 20, 1973 and U.S. Pat. No. 3,134,114 issued on May 26, 1964.

U.S. Pat. No. 3,255,472 while not directed to water ski aquatic devices, in themselves, concerns an attachment for such water skis which can be used to create a water spray or plume as the ski moves through the water. The attachment comprises a trough shaped mounting assembly which is disposed at the rear end of the ski and supports a rigid conduit. The mounting assembly is longitudinally tapered with its major end forwardmost and its minor end rearward and extending beyond the rear of the water ski. The front conduit extends into the rear opening of the mounting assembly and the rear end of the conduit is inclined upwardly and terminates in a flattened end. In use, rapid movement of the water ski causes water to be forced into the forward end of the rigid conduit member by ram action and to be discharged rearwardly and upwardly out of the flattened end in such a manner as to produce a spray or plume of water which trails the ski.

It is an object of the present invention to provide an aquatic apparatus having enhanced stability and ease of operation when moved through the water.

It is a further object of the present invention to provide a water ski aquatic apparatus having enhanced stability and ease of operation.

SUMMARY OF THE INVENTION

The above and other objectives are realized in accordance with the principles of the present invention by an aquatic apparatus wherein the apparatus comprises a member adapted to be moved through water and, in addition, means attached to the aforesaid member for forming a chamber having an inlet opening and a substantially unobstructed outlet opening through which water passes therethrough and a cross section whose area continuously decreases in going from the inlet opening to a point beyond the inlet opening in the direction of the outlet opening.

The aquatic apparatus of the present invention is thus, provided with a chamber whose cross section decreases in area in going from the inlet toward the outlet of the chamber and, therefore, a chamber having the configuration of a venturi tube. Water passing through the chamber is thus accelerated and compressed, thereby causing a concentration of the water in passing through the chamber. Where the member to which the chamber is attached rides with only a portion of its surface including that attached to the chamber below the surface of the water, the aforesaid concentration acts, in part, to lock the chamber and, hence, the member in the water. Enhanced stability and operating characteristics thereby result.

In a specific embodiment of the invention to be disclosed hereinafter, the member is a planar member which extends longitudinally and laterally to form a water ski body and the aforesaid means includes a rearward surface portion of the member and a plate member extending below this surface portion and having opposite ends adjacent the sides thereof. In this embodiment, the aforesaid plate, in addition to locking the water ski in the water, acts as the rear fin or skag of the ski, whereby additional stability is realized due to the additional control surfaces provided thereby.

In a further aspect of the invention, the aforesaid water ski aquatic apparatus is provided with further means to facilitiate ease of handling and, in particular, promote vertical orientation of the ski at the time of starting. More particularly, the rearward surface portion of the ski above the plate or skag is provided with an aperture in which is disposed a pivotal valve or vane for opening and closing same. The vane is further provided with an extension which extends beyond the rear wall of the aperture. The aperture, in turn, communicates with an enclosed channel running toward the front of the ski and formed in the ski body. An air inlet or opening in the front of the ski body conveys air into the chamber.

In still a further aspect of the invention, the pivotal vane of the water ski is provided with apertures which promote the formation of a bubble pattern which acts as a ball bearing surface for the rear of the ski to ride on.

In yet a further aspect of the invention, the water ski of the invention is provided with a unique boot arrangement which is adjustable for achieving both a given foot size and weight distribution.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
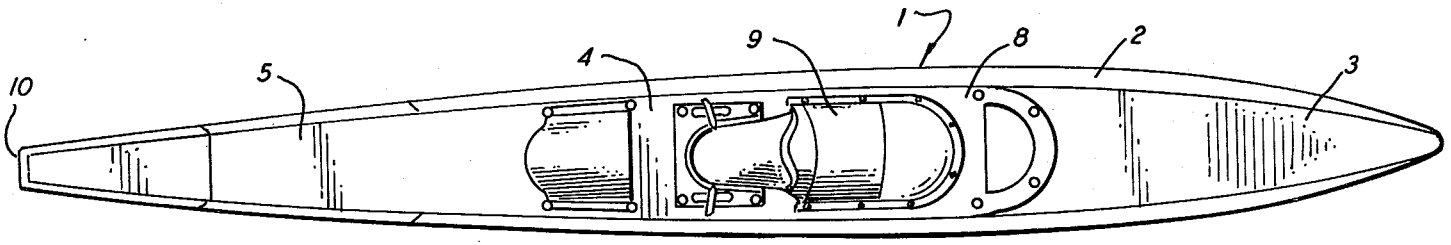
FIGS. 1 through 3 show top, side and rear views of a water ski aquatic apparatus in accordance with the principles of the present invention.
Figure 2:
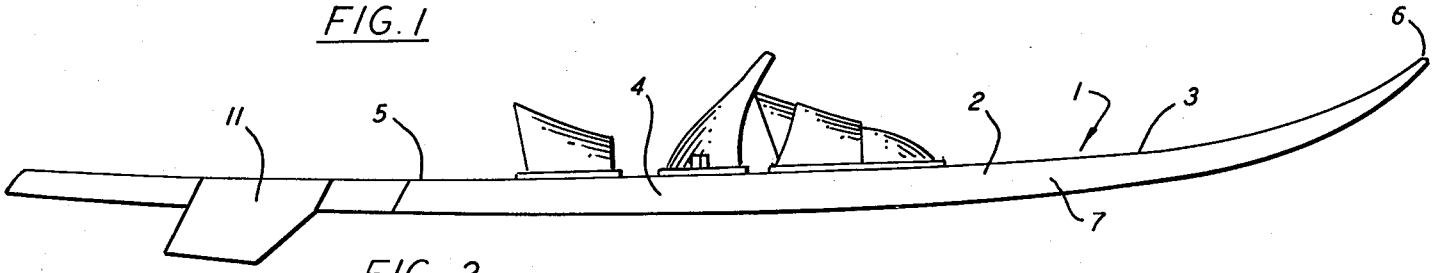
Figures 3, 4, 5:
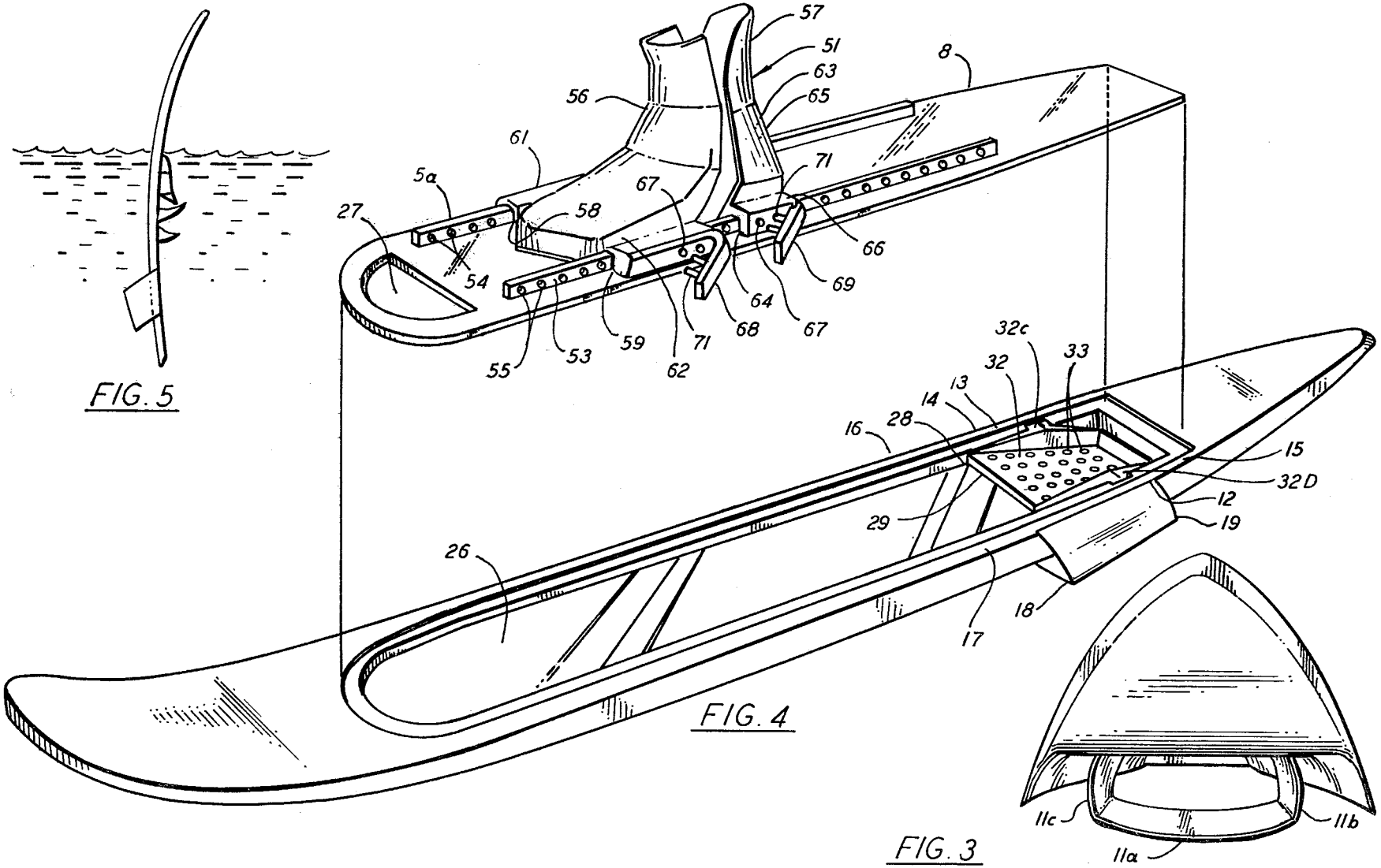
FIG. 4 illustrates in greater detail the body of the water ski of FIGS. 1 through 3 with the ski body further modified to include a novel boot arrangement.
FIG. 5 shows the water ski of FIG. 1 in the water in its standstill position.

FIGS. 1 through 3 illustrate a water ski aquatic device or apparatus in accordance with the principles of the present invention. As illustrated, the water ski 1 includes a longitudinally and laterally extending body 2 having a front section 3, a middle section 4 and a rear section 5. The front section 3 has a front end 6 which turns upwardly in a conventional manner, and a rear end 7 which terminates at the front of an upper plate 8. The latter plate supports a conventional binding structure or assembly 9 provided for engaging the foot of the skier. The plate 8 extends rearward of the front section 3 throughout the length of the central section 4 and terminates at a point in the rear section 5 which is forward of the rear tip 10 of the ski.

In accordance with the principles of the present invention, the water ski 1 is further provided in the area of the rear section 5 of the body 2 with a rear tail or a skag 11 constructed to promote enhanced stability and maneuverability of the ski. More particularly, as shown in FIG. 4, the skag 11 is in the form of a curved plate or sheet member whose opposite ends 12 and 13 are secured to portions 14 and 15, respectively, of the sides 16 and 17 of the rear ski section 5. Typically, screws may be used to secure the skag ends to the corresponding sides but other means of attachment may also be used. Attachment may also be enhanced by indenting the portions 14 and 15 of sides 16 and 17 and fitting the skag ends within their respective indentations.

As evidenced in FIGS. 2, 3, 4 and 7, the skag 11 is further constructed such that the lateral circumference of the skag measured between sides 16 and 17 continuously decreases and the thickness t of the skag continuously increases from its front end 18 to a point A beyond this end in the direction of its rear end 19. As shown, beyond the point A in the direction of the end 19, the circumference of the skag continues to decrease, while the thickness of the skag now also decreases.

With the aforesaid construction for the skag 11, the skag and the bottom surface portion 21 of the rear section 5 form an enclosed chamber 22 having an inlet or front opening 23, a rear or outlet opening 24 and a transverse cross section which continuously decreases from the opening 23 to the point A going in the direction of the opening 24. Beyond the point A going in the direction of the opening 24, the area of the aforesaid cross section no longer changes, but rather stays at its point A value. The chamber 22 thus has the form of a venturi tube. As a result, when the ski 1 is set in motion, water passing under the rear section 5 of the ski and through the chamber 22 will be accelerated and compressed, thereby locking the tail of the ski in the water. This locking effect permits the ski to be cornered in an ultrahard manner without the ski sliding out. The stability of the ski is thus significantly enhanced. Ski stability is further enhanced due to the presence of three control surfaces provided by the skag configuration. Thus, the skag has a bottom control surface 11*a* and two side control surfaces 11*b* and 11*c* all of which aid in the overall maneuverability of the ski.

In order to further facilitate such maneuverability and stability, the water ski 1 is provided with further means for injecting air into the chamber 22 whereby a bubble pattern is produced under the rear section 5 of the ski. This bubble pattern creates a small ball-bearing like surface for the ski to ride on. Surface tension between the ski and water is thereby reduced and the ski is able to better glide through the water.

As shown, the aforesaid means comprises an air channel 25 formed by a centrally disposed depressed region 26 of the ski body 2, which region runs along the length of the central section 2 and terminates in the rear section 5 beyond the outlet opening 24 of the skag 11. This central depression is closed off or covered by the top plate 8 to thereby form the air channel 25.

An opening inlet 27 in the front end of the plate 8 serves to couple air into the air channel 25. In turn, air is coupled out of the channel 25 through an aperture 28 which opens into the rear end of the channel 25 in the area of the rear section 5 encompassing the bottom surface portion 21. As shown, the front end 29 of the aperture 28 is approximately on a line with the bottom of the inlet opening 23 of the skag 11, the center of the aperture is approximately on a line with the point A, and the rear end 31 of the aperture is approximately on line with the bottom of the outlet opening 24. Mounted within the aperture 28 is a means for segmenting the aperture into outlet openings in the form of a plurality of air injection nozzles. This means is in the form of a vane or valve comprised of a plate 32 which closes the aperture and is provided with nozzle-shaped or tapered openings 33.

Figure 8:
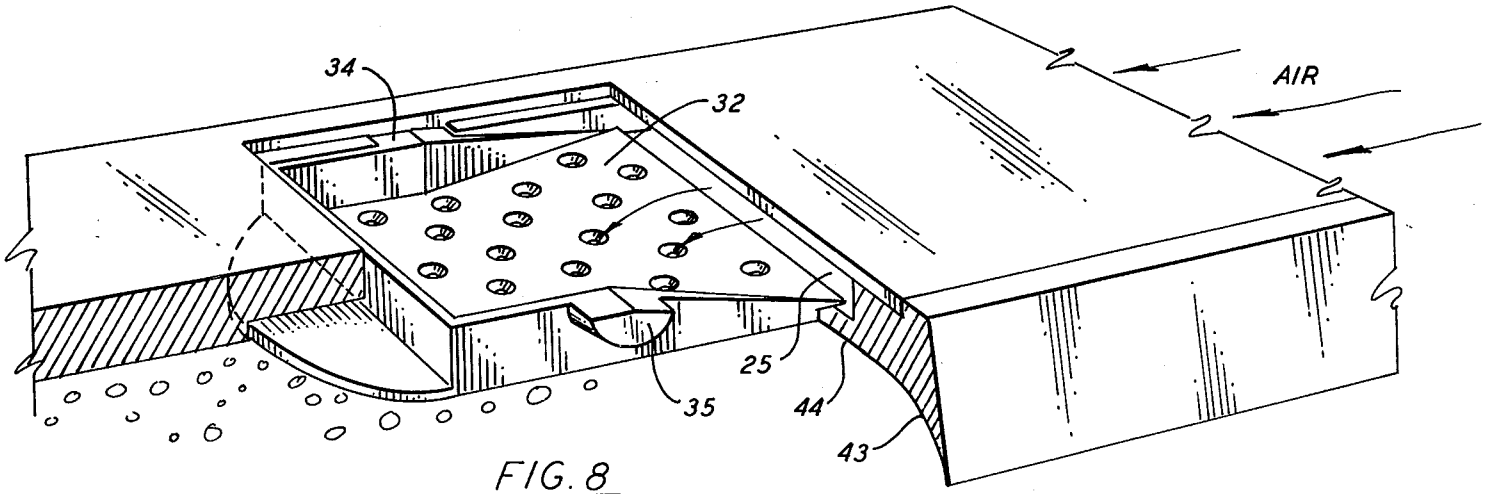
FIG. 8 shows in partial cross section the rear ski section of FIG. 6.
Figure 7:
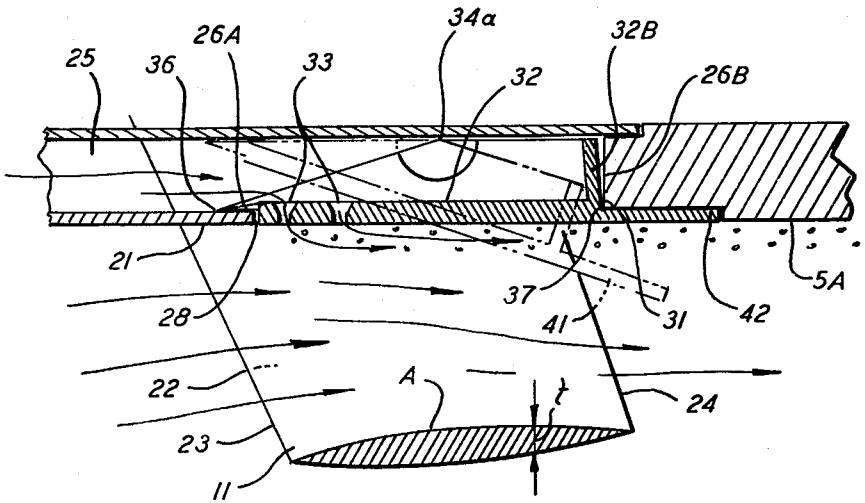
FIG. 7 illustrates a cross section of the rear ski section of FIG. 6 taken along the line 7—7 of FIG. 6.
Figure 6:
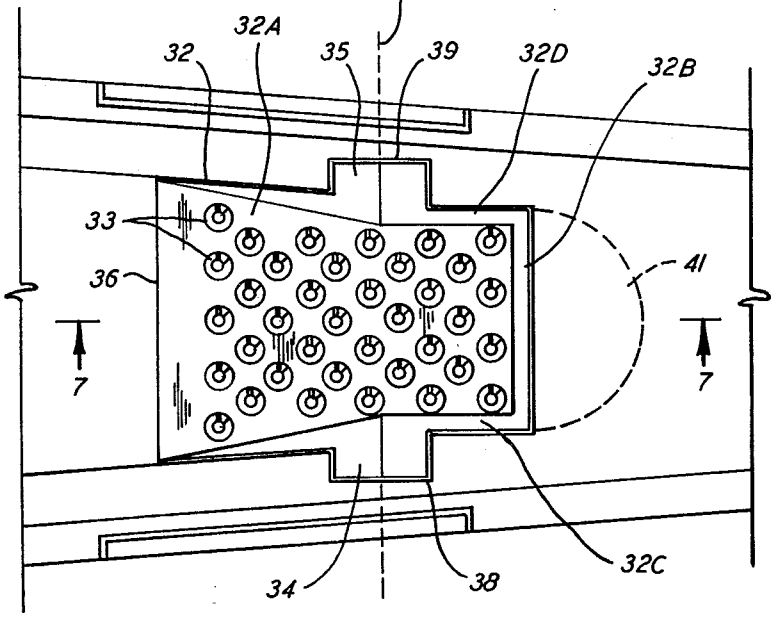
FIG. 6 illustrates a top view of the rear section of the ski body of FIG. 4.

As can be seen from FIGS. 7 and 8, during movement of the ski 1 air enters the channel 25 through the front opening 27 and passes along the length of the channel to the injection nozzles or openings 33 in the vane 32. The latter nozzles, in turn, inject the air into the accelerated water passing through the chamber 22, thereby causing the formation of bubbles whose pattern corresponds to that of the nozzles. By providing openings over the entire length of the vane, as shown, a bubble pattern having maximum dispersion results. This pattern of bubbles, in turn, passes under the rear end 5A of the ski section 5 and, as above-described, act as a ball-bearing type surface for the end 5A to ride on. The surface tension between the ski 1 and water is thus reduced, thereby permitting faster and smoother movement of the ski.

It should be noted that the aforesaid passage of air into the chamber 22 via the opening 27, the channel 25 and the openings 33 is facilitated by the venturi-like configuration of the chamber. Thus, as above-noted, with this type of configuration for the chamber 22, the area of the cross section of the chamber continuously decreases in going from the inlet opening 23 to the point A, which lies below and on line with the center of the aperture 28 and, hence, the center of the vane 32. Water passing through the chamber is thus accelerated and compressed, with the maximum acceleration and compression occurring at the point of smallest cross section, i.e., at the point A and, hence, under the center of the vane. As a result, a partial vacuum is created under the vane, this vacuum being strongest at the vane center. This vacuum, in turn, causes the air above the openings 33 and in the channel 25 to be drawn through the openings and into the chamber 22, thereby creating the bubble pattern as above-described.

In further accord with the invention, the water ski 1 is additionally constructed so as to promote use of the ski by the skier. In particular, the ski is constructed so that when resting in the water, the ski takes on an upright substantially vertical position as shown in FIG. 5. This automatic positioning of the ski at rest permits the skier to assume the starting ski position (skis vertical) with little difficulty.

More particularly, in accordance with the invention the vane 32 is pivotably mounted, for rotation about a lateral line 34*a* in the aperture 28 such that in the rest position of the ski the vane pivots opening the aperture 28 and allowing water to directly flow into the channel 25, thereby causing the ski to partially sink and to assume a vertical orientation with the end 6 upward.

More particularly, as shown in FIGS. 4, 6, 7 and 8, the vane 32 has a substantially flat central region 32A whose top surface is slightly above that of the top surface of the rear end 26A of the depression 26 and in which are disposed the openings 33. At the rear end of the region 32A, a back wall 32B abuts the rear end wall 26B of the depressions 26 and extends transversely or upward to a point where it also abuts the top plate 8. At the lateral ends of the vane 32, upwardly or transversely extending sidewalls 32C and 32D abut the lateral endwalls of the aperture 28 and extend to a point where they also abut the plate 8. The sidewalls 32C and 32D are provided with laterally extending bearing members 34 and 35 which are situated between the front end 36 and rear wall 32B of the vane. These bearing members ride in bearing surfaces 38 and 39 provided in the lateral endwalls of the aperture 28 and permit pivoting of the vane 32 to its open position (shown in phantom line in FIG. 7) and to its closed position. As illustrated, in its open position, the vane pivots so that its front end enters the channel 25 and its rear end enters the water. To ensure proper closure of the vane, the underside of the front end 36 of the vane is slotted so as to mate with a corresponding end 26A of the depression 26. The vane thus lies flush with the bottom surface 21 when in a closed position.

In order to further facilitate opening and closing of the vane, an extension in the form of a thin plate 41 is provided at the lower rear end 37 of the vane. A further depression 42 which corresponds to the configuration of the extension 41 is provided in the bottom surface 21 rearward of the rear end 31 of the aperture 28. In this manner, when vane 32 is in its closed position, the extension 41 lies within the depression 42 and, hence, is also flush with the bottom surface 21.

The operation of the pivoting vane 32 is as follows. In the rest position of the ski, the extension 41 drops downwardly slightly as the vane pivots and is thereby engaged by the water and urged further downward. This, in turn, causes further pivoting of the vane and, hence, the vane becomes fully opened. Water then enters the aperture 28 and fills the channel 25, thereby causing the ski to sink and take on a vertical orientation. Movement of the ski then causes an upward force on the extension 41, thereby pivoting the vane 32 causing same to close the aperture 28. Moreover, as the ski moves, the vacuum created in the chamber 22 creates a suction on the water in the channel 25 causing the water to be sucked out of the channel through the openings 33 in the vane 32. After all the water is removed from the channel, air is then pulled therethrough to create the bubble pattern under the rear of the ski as described above.

As can be appreciated, in the aforesaid operation, the construction of the vane 32 with the flat central portion 32A and the upwardly extending rear wall and sidewalls 32B, 32C and 32D permits the vane to provide a substantially complete mechanical seal in both its open and closed positions. Thus, when the vane is closed, the sidewalls and rear wall seal the periphery of the aperture 28, thereby permitting air and water flow through the openings 33 only. When the vane is open, on the other hand, the rear wall and end walls seal the rear periphery of the aperture, so that water entering the channel through the front cannot leak out and is forced to continue into the channel 25.

It should also be noted that the degree of sinking of the ski 1 when the channel 25 fills with water can be controlled by filling the front section 3 and the sides of the ski adjacent the depression 26 with an appropriate buoyant material such as, for example, urethane foam. The amount of buoyant material used and its particular location will, of course, depend upon the particular application as well as on other factors such as the ski material, the dimensions of the depression 26, etc.

Further enhanced stability and maneuverability of the water ski 1 is realized by contouring the lateral edges 43 of the bottom surface of the ski forward and rearward of the skag 11 so that they force water to flow through the skag. As shown in FIG. 8, this is accomplished by curving the edges 43 downward relative to the substantially flat central portion 44 of the bottom surface. In addition to promoting water flow through skag 11, these edges provide additional control surfaces, function as cutting edges during cornering, and promote lift off the water, thereby significantly improving ski maneuverability.

FIG. 4 shows a further aspect of the water ski of the present invention wherein the conventional ski binding or boot 9 shown in FIG. 1 has been replaced by a ski boot arrangement 51 in accord with the invention. More particularly, the arrangement 51 comprises two rails or guides 52 and 53 which are disposed on the lateral ends of the ski and which run along the length of the ski. As shown, the rails are disposed on the lateral ends of the plate 8. The rails 52 and 53 are provided with corresponding pluralities of apertures 54 and 55 which permit locking of rear and front molded boot sections 56 and 57 thereto.

The boot sections 56 and 57 are designed to conform to the front and rear portions of a skier's foot, respectively, and are slidably mounted on the rails independently of one another. More specifically, the boot section 56 is provided with slots 58 and 59 in the bottom of its lateral end walls 61 and 62 and the boot section 57 with slots 63 (not shown) and 64 in the bottom of its lateral endwalls 65 (not visible) and 66, for engaging and riding on the respective rails 52 and 53. Running through each slotted lateral endwall and extending into the inner wall of the boot section corresponding thereto are pluralities of holes, only the holes 67 of the lateral endwall 66 and the holes 67 of lateral end wall 62 being visible in the drawing. The plurality of holes in each slotted lateral end are spaced correspondingly to the apertures in their respective rail and can be aligned therewith by movement of their respective boot section. Locking bars carrying pluralities of locking pins are further provided for locking the lateral ends 61, 62, 65 and 66 of the boot sections in place at a given position along the rails. In the drawing, only the locking bars 68 and 69 for locking the lateral ends 62 and 66 of the boot sections 56 and 57 are visible.

As can be seen from the locking bar 66, each locking bar is pivotally attached via one longitudinal end to its respective lateral endwall and the locking pins 71 of each bar face inwardly toward and are aligned with the holes in that wall. In operation, after the holes in the slotted lateral endwalls have been aligned with the apertures in the respective rails associated with a desired foot size and weight distribution, the boot sections can then be locked in place by bending or pivoting the locking bars. This causes the pins carried by the bars to pass through the endwalls and the rails into the inner boot walls, thereby locking the boot sections to the rails.

As can be appreciated, the boot sections 56 and 57 can be adjusted to realize both a given foot size and a given weight distribution. Thus, foot size can be varied by movement of either the rear or front boot section by the degree necessary to accommodate the skiers foot. Weight distribution, in turn, can be varied by then moving both front and rear sections simultaneously to the proper position for appropriate weight distribution for maximum control. Once having positioned the boot sections for the desired foot size and weight distribution, the locking bars can be inserted and the boot sections locked in place, as above-described.

The boot construction of FIG. 4 thus permits rapid adjustment of the water ski to accommodate both the foot size and weight of a given skier. The ski can, therefore, be readily adjusted for use by children and adults and the necessity of providing skis of different lengths for this purpose is completely obviated.

In all cases, it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A water ski comprising:

a longitudinally and laterally extending member, said member having a front longitudinal end and a rear longitudinal end;

means for causing said member to lie in the water in the rest position with said front longitudinal end pointing upward and said rear longitudinal end pointing downward, said means comprising:

an aperture disposed in the lower surface of and situated toward said rear longitudinal end of said member;

a channel within said member communicating with said aperture; and a vane pivotally mounted in said aperture for selectively inhibiting the flow of water through said aperture in a direction into said member.

2. A water ski in accordance with claim 1 wherein:

said vane is pivotal about a lateral line situated between the longitudinal ends of said vane.

3. A water ski in accordance with claim 2 wherein:

said vane includes bearing members extending laterally from its opposite lateral ends in the direction of said line;

and said aperture has slots in its opposite lateral endwalls for receiving said bearing members.

4. A water ski in accordance with claim 1 and further comprising an extension member connected to the end of said vane facing said longitudinal rear end of said member and extending beyond said aperture in the direction of said longitudinal rear end of said member.

5. A water ski in accordance with claim 4 wherein:

said lower surface has a depression adjacent the end of said aperture facing said longitudinal rear end of said member for receiving said extension.

6. A water ski in accordance with claim 5 wherein:

said vane has a lateral slot at its end facing said front longitudinal end of said member;

and the lower surface of said channel adjacent the end of said aperture facing said front longitudinal end of said member has a lateral edge for mating with said lateral slot.

7. A water ski in accordance with claim 1 further comprising:

an opening in said member and communicating with said channel.

8. A water ski in accordance with claim 7 wherein:

said opening is disposed in the upper surface of said member at a point closer to said front longitudinal end than said aperture and said vane has a plurality of openings disposed therein.

9. A water ski in accordance with claim 8 wherein:

said member has a depression extending from said aperture toward said front longitudinal end and includes a plate member for covering said depression to form said channel;

and said opening is in said plate.

10. Apparatus comprising:

(a) a longitudinally and laterally extending member to be moved through water having a lower surface for contacting water and an upper surface and having a front longitudinal end and an oppositely disposed rear longitudinal end;

(b) means for injecting air below said lower surface comprising:

(i) at least one outlet opening disposed in said lower surface;

(ii) an inlet opening disposed in an area of said upper surface of said member removed from said lower portion; and (iii) a channel within said member connecting said at least one outlet opening and said inlet opening; and (c) means, forming a chamber with a portion of said lower surface, attached to said member, said chamber having an inlet opening and a substantially unobstructed outlet opening through which water passes and a cross-section whose area continually decreases, going from said inlet opening to a point beyond said inlet opening in the direction of said outlet opening.

11. Apparatus in accordance with claim 10 wherein:

said portion of said lower surface is toward the end of said lower surface adjacent said rear longitudinal end.

12. Apparatus in accordance with claim 11 wherein:

said means includes a plate member having a central region and opposite ends connected to said central region, said opposite ends of said plate member being arranged adjacent opposite sides of said member and said central region of said plate member extending below said lower surface portion to form said chamber.

13. Apparatus in accordance with claim 12 wherein:

said central region is curved.

14. Apparatus in accordance with claim 13 wherein:

the circumference between said opposite sides of said member decreases and the thickness of said plate increases in moving from said inlet opening to said point.

15. Apparatus in accordance with claim 12 wherein:

said sides of said member are slotted to receive said opposite ends of said plate.

16. Apparatus in accordance with claim 10 wherein:

said means for injecting has a plurality of outlet openings disposed in said lower surface in a pre-selected pattern said inlet opening is disposed in the top surface of said member at a point therein that is closer to said front longitudinal end than said plurality of openings; and said channel connects all said plurality of outlet openings to said inlet openings.

17. Apparatus in accordance with claim 10 wherein:

said apparatus further includes means for causing said member to lie in the water in the rest position with said front longitudinal end pointing upward and said rear longitudinal end pointing downward.

18. Apparatus in accordance with claim 17 wherein:

said means for causing said member to lie comprises:

an aperture disposed in said lower surface portion;

and said channel within said member communicating with said aperture.

19. Apparatus in accordance with claim 18 further comprising:

means for selectively inhibiting water flow through said aperture in a direction into said member.

20. Apparatus in accordance with claim 19 wherein:

said means for inhibiting comprises a vane pivotably mounted in said aperture so as to close when said ski is brought into motion.

21. Apparatus in accordance with claim 20 wherein:

a plurality of outlet openings are arranged in said vane.

22. Apparatus in accordance with claim 10 wherein said member forms the body of a water ski.

23. Apparatus according to any one of claims 5, 12, 16, 17, 18, 19, 20 and 21, wherein said member forms the body of a water ski.

24. A water ski comprising:

(a) a longitudinally and laterally extending member, said member having a front longitudinal end and a rear longitudinal end;

(b) first and second rails arranged adjacent opposite lateral ends of said member having corresponding pluralities of apertures distributed along their length;

(c) a front boot section, said front boot section having slots in its bottom surface adjacent its opposite lateral ends for engaging and riding on said first and second rails, respectively;

(d) a rear boot section disposed closer to said rear longitudinal end than said front boot section, said rear boot section having slots in its bottom surface adjacent its opposite lateral ends for engaging and riding on said first and second rails, respectively;

(e) first and second locking bars pivotally attached to one end to opposite lateral ends, respectively, of said rear boot section;

(f) first and second pluralities of pins connected to said first and second locking bars, respectively, each of said first and second pluralities of pins extending inwardly toward their respective lateral end and being distributed similarly to said apertures in said rails;

(g) first and second pluralities of apertures extending through opposite lateral ends, respectively, of said rear boot section, and into inner walls of said rear boot section, said first and second pluralities of apertures being distributed similarly to the apertures in said rails, (h) third and fourth locking bars pivotally attached at one end to opposite lateral ends, respectively, of said front boot section;

(i) third and fourth pluralities of pins connected to said third and fourth locking bars, respectively, each of said third and fourth pluralities of pins extending inwardly toward their respective lateral end and being distributed similarly to said apertures in said rails; and (j) third and fourth pluralities of apertures extending through opposite lateral ends, respectively, of said front boot section, and into inner walls of said front boot section, said third and fourth pluralities of apertures being distributed similarly to the apertures in said rails.

* * * * *